US010220536B2

(12) United States Patent
Bernede

(10) Patent No.: US 10,220,536 B2
(45) Date of Patent: Mar. 5, 2019

(54) DEVICE FOR CUTTING FOODSTUFFS

(71) Applicant: Distri Coutale, Vire sur Lot (FR)

(72) Inventor: Philippe Bernede, Vire-sur-Lot (FR)

(73) Assignee: DISTRI-COUTALE, Vire sur Lot (FR)

( * ) Notice: Subject to any disclaimer, the term of this patent is extended or adjusted under 35 U.S.C. 154(b) by 0 days.

(21) Appl. No.: 15/311,997

(22) PCT Filed: Jun. 10, 2015

(86) PCT No.: PCT/FR2015/051530

§ 371 (c)(1),
(2) Date: Nov. 17, 2016

(87) PCT Pub. No.: WO2015/189520

PCT Pub. Date: Dec. 17, 2015

(65) Prior Publication Data

US 2017/0106551 A1 Apr. 20, 2017

(30) Foreign Application Priority Data

Jun. 13, 2014 (FR) ..... 14 55448

(51) Int. Cl.

| | |
|---|---|
| ***B26D 3/26*** | (2006.01) |
| ***B26D 3/28*** | (2006.01) |
| ***B26D 1/06*** | (2006.01) |

(52) U.S. Cl.

CPC ..... *B26D 3/26* (2013.01); *B26D 1/06* (2013.01); *B26D 3/28* (2013.01); *B26D 3/283* (2013.01); *B26D 2003/285* (2013.01); *B26D 2003/286* (2013.01); *B26D 2003/287* (2013.01)

(58) Field of Classification Search

CPC . B26D 3/26; B26D 3/283; B26D 1/06; B26D 2003/285; B26D 2003/286; B26D 2003/287

See application file for complete search history.

(56) References Cited

U.S. PATENT DOCUMENTS 4,212,431 A * 7/1980 Doyel ..... A47J 43/25 241/100
4,928,893 A * 5/1990 Prindle ..... A47J 43/25 241/100

(Continued)

FOREIGN PATENT DOCUMENTS

CN 201872186 U 6/2011
CN 202053285 U 11/2011

(Continued)

*Primary Examiner* — Omar Flores Sanchez
(74) *Attorney, Agent, or Firm* — Paul & Paul

(57) ABSTRACT

The invention relates to a foodstuff-cutting device called a mandoline of the type comprising a moving blade support defining a cutting plane and moving in a reciprocating translational movement in relation to the foodstuff in accordance with an inverted configuration and having a sleeve associated with a plunger allowing foodstuffs to be inserted and kept in the pathway of the moving blade support remarkable in that it comprises a receptacle with a lid preformed with a passageway which, arranged transversely in relation to the travel of the moving blade support, receives a sleeve associated with the plunger thereby allowing food stuffs to be inserted and kept in the pathway of the moving blade support.

16 Claims, 6 Drawing Sheets

(56) References Cited

U.S. PATENT DOCUMENTS

| | | | | |
|---|---|---|---|---|
| 5,445,332 | A * | 8/1995 | Shimizu | A47J 43/082 241/100 |
| 5,765,472 | A * | 6/1998 | Kim | B26D 3/283 83/167 |
| 7,543,768 | B2 * | 6/2009 | Cohen | B26D 3/283 241/100 |
| 2008/0156204 | A1 * | 7/2008 | Cohen | B26D 3/283 99/492 |
| 2010/0180778 | A1 * | 7/2010 | Walker | B26D 3/28 99/537 |
| 2012/0180612 | A1 | 7/2012 | Holcomb et al. | |

FOREIGN PATENT DOCUMENTS

| | | | |
|---|---|---|---|
| DE | 202010001260 | U1 | 5/2010 |
| WO | 2004071720 | A1 | 8/2004 |
| WO | 2012180612 | A1 | 7/2012 |

* cited by examiner

DEVICE FOR CUTTING FOODSTUFFS

PRIORITY CLAIM

This utility application claims priority to PCT/FR2015/051530 (publication number WO 2015/189420 A1), filed on Jun. 10, 2015, which claims priority to FR1455448, filed on Jun. 13, 2014.

FIELD OF INVENTION

This invention relates to the field of kitchen utensils for cutting foodstuffs also known by the name of mandolines. This invention relates in particular to a mandoline with an inverted configuration, in other words where the cutting blade moves in relation to the fixed position of the vegetable or other foodstuff.

BACKGROUND

The invention relates to a foodstuff-cutting device (D) called a mandoline of the type comprising a moving blade support (100) defining a cutting plane and moving in a reciprocating translational movement in relation to the foodstuff in accordance with an inverted configuration and having a sleeve (400) associated with a plunger (410) allowing foodstuffs to be inserted and kept in the pathway of the moving blade support (100), remarkable in that it comprises a receptacle (200) with an opening (210) having edges presenting sliding surfaces for said moving blade support, a lid (300) which, independent of the receptacle (200), closes the latter by engaging with said edges (220) and by keeping said moving blade support (100) in contact with the sliding surfaces, said lid (300) being performed with a passageway (310) which, arranged transversely in relation to the travel of the moving blade support (100), receives the sleeve (400) associated with a plunger (410) allowing food stuffs to be inserted and kept in the pathway of the moving blade support (100).

DESCRIPTION OF THE PRIOR ART

A mandoline is a kitchen utensil for cutting foodstuffs, and more particularly raw vegetables, into slices whose thickness is adjustable by means of setting the plane of trajectory of the cutting blade.

This typically manual vegetable slicer conventionally comprises a fixed blade associated with a fixed surface upon which there is the movement of the vegetable against the blade so that when moved back and forth and held against said surface by the user, the vegetable is gradually sliced. Each pass of the vegetable typically results in a slice of the vegetable through a slot next to the blade, and the face of the vegetable then drops down against the surface for the next pass over the blade.

There is also an inverted configuration where it is the blade support that is moved in relation to the fixed vegetable that is held against said support. An example of such a configuration is described in Document CN202053285.

Another example of such a configuration is described in Document WO2012/097214. This document describes a hand-operated slicer incorporating a casing, a base and a reciprocating blade assembly. The casing has an upper part, opposing lateral parts, a chamber to hold the foodstuffs and a passageway that, extending along the length of the chamber between the lateral sides, is aligned with a cutting plane. The base is connected to the casing and configured so as to prevent the casing from moving during the slicing operation. The reciprocating blade assembly is engaged sliding in the passageway of the casing and supports a blade that moves across the food-retaining chamber or adjacent thereto when the assembly performs a back and forth movement, so as to slice a foodstuff in the chamber. The blade assembly may be adjustable in order to alter the thickness of the cut and may be convertible in order to create chips and juliennes or suchlike. This configuration has several drawbacks, including those listed below:

- the casing has a complex shape, difficult to manufacture so as to ensure the translational guidance of the blade assembly, and that of the means of pressing down on the vegetable, along a perpendicular axis to the surface,
- the said casing is not associated with a container because it is associated with a base comprised of folding elements constituting the non-slip feet for the casing,
- the chamber and the means of pressing down on the vegetable cannot to the longitudinal or transverse cut nor to the shape of the vegetable,
- the blade assembly cannot be used as a conventional non-inverted mandoline.

DETAILED DESCRIPTION

Figure 1:
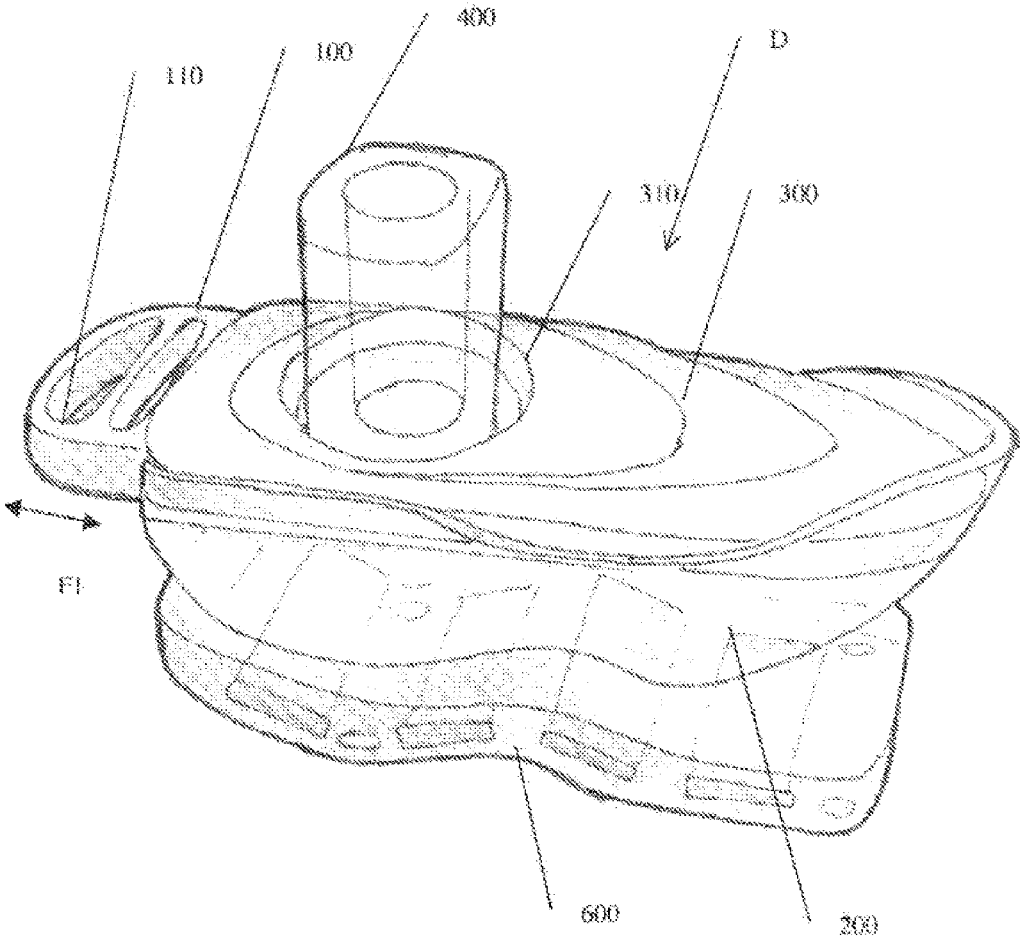
FIG. 1 is a schematic drawing of a perspective view of an embodiment of a device according to the invention.
Figure 2:
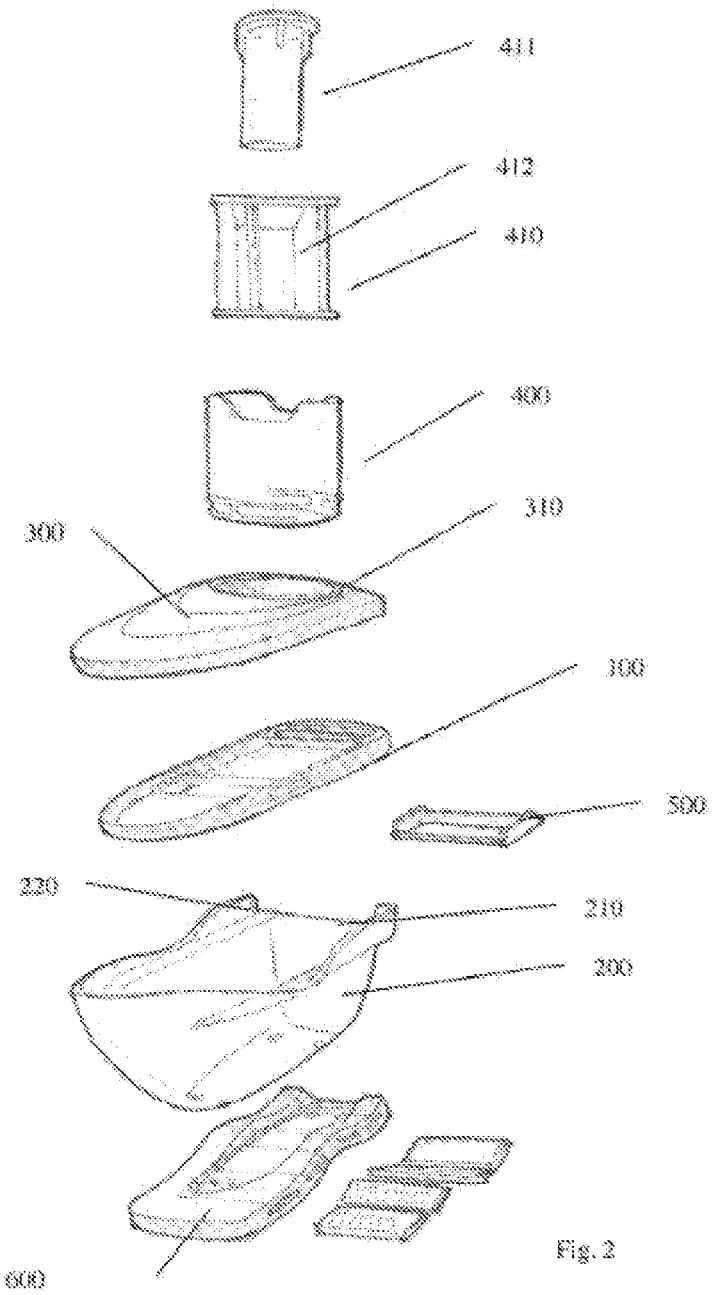
FIG. 2 is a schematic drawing of an exploded perspective view of the device in FIG. 1.
Figure 3:
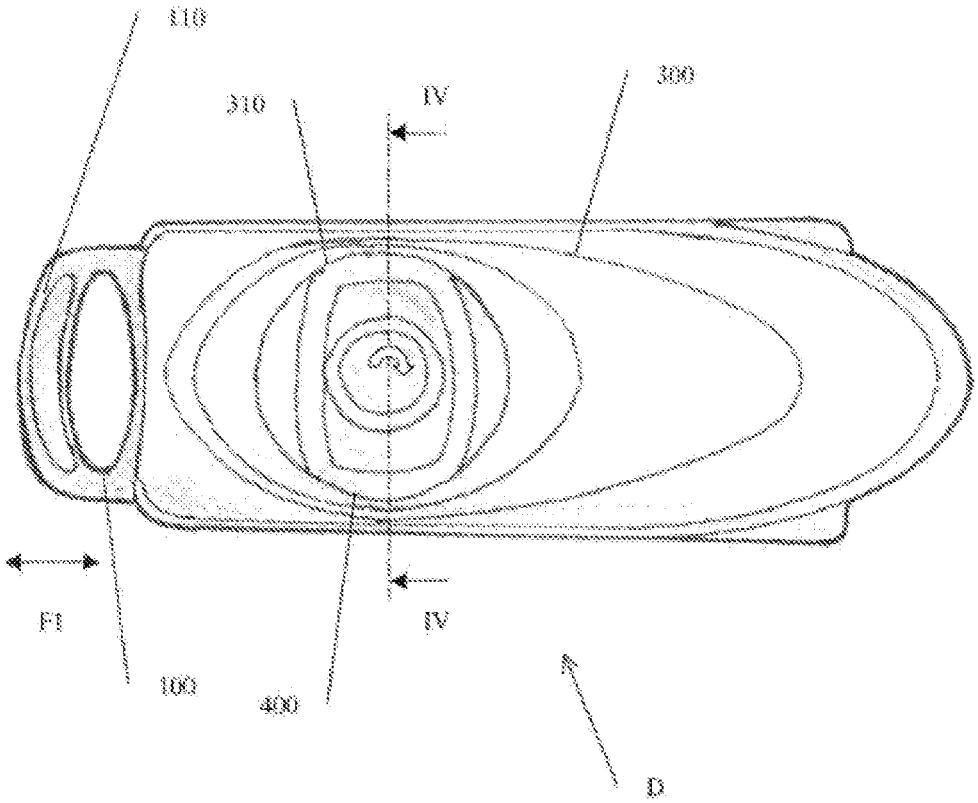
FIG. 3 is a schematic drawing of a top view of the device in FIG. 1.

Various examples of the invention will now be described. The following description provides specific details for a thorough understanding and enabling description of these examples. One skilled in the relevant art will understand, however, that the invention may be practiced without many of these details. Likewise, one skilled in the relevant art will also understand that the invention can include many other features not described in detail herein. Additionally, some well-known structures or functions may not be shown or described in detail below, so as to avoid unnecessarily obscuring the relevant description. The terminology used below is to be interpreted in its broadest reasonable manner, even though it is being used in conjunction with a detailed description of certain specific examples of the invention. Indeed, certain terms may even be emphasized below; however, any terminology intended to be interpreted in any restricted manner will be overtly and specifically defined as such in this Detailed Description section.

This invention relates to a mandoline with a reciprocating inverted configuration that overcomes the above-mentioned drawbacks.

According to this invention, the mandoline foodstuff-cutting device is of the type comprising a moving blade support, where the motion of the blade defines a cutting plane and when in use, the blade moves in a reciprocating translational movement in relation to the fixed foodstuff in accordance with an inverted configuration and having a sleeve associated with a plunger allowing foodstuffs to be inserted and kept in the pathway of the moving blade support. This device is remarkable in that it comprises a receptacle with an opening having edges presenting sliding surfaces for said moving blade support, a lid which, independent of the receptacle, closes the latter by engaging with said edges and by keeping said moving blade support in contact with the sliding surfaces, said lid being preformed with a passageway which, arranged transversely in relation to the travel of the moving blade support, receives the sleeve associated with a plunger allowing food stuffs to be inserted and kept in the pathway of the moving blade support.

This device is particularly advantageous in that it includes a storage module for the cut food and supports the translational reciprocating movement of the blade support. Moreover, the independence of the container and its lid enables easy release of the blade support that can thus be used as a conventional mandoline. Moreover, the lid and moving blade support can be used separately to the container.

Equally, this separation will make it easier to clean the various constituent parts.

Another advantage lies in the ease of manufacturing simpler separate components. By using the edge of the receptacle as a sliding surface, the invention shares part of the performance of the guiding function among several elements, which facilitates their manufacture, particularly by plastic molding.

Thus, according to another particularly advantageous characteristic, said edges and lid are preformed so that the said lid fits into the edges and presents longitudinal vertical sliding surfaces to said moving blade support.

The distribution between the horizontal sliding surfaces preformed on the receptacle and the longitudinal vertical sliding surfaces preformed on the lid allows the high stresses associated with the thrust on the foodstuff (and therefore on the movable blade support) to be transmitted during cutting to the more massive element.

Another characteristic contributing to good guiding is that the longitudinal edges of said moving support are provided with projections cooperating, for the purpose of guiding and holding, with corresponding longitudinal grooves made in the bottom face of the lid. The simplification of manufacture thus allows optimized guiding to be achieved.

Certain particularly advantageous characteristics of this device lie in the design of the means of receiving the foodstuff and placing it in contact with the blade support. Thus, according to a particularly advantageous characteristic, the said food plunger slides in the sleeve and has two subcomponents:

- the first plunger which, sliding while being in direct contact with the sleeve, is preformed with a channel for smaller foodstuffs to pass through,
- a second plunger sliding in the said the said channel.

This possibility of having a plunger to suit the size of the foodstuffs is particularly advantageous when using the device and for achieving a good cutting result. This second plunger is designed so as to retract into the first, thus preventing any projecting volume.

Moreover, according to another particularly advantageous characteristic of the invention, the said channel has an oblong profile and is preformed to cooperate with the said lid in order to allow the sleeve to adopt various positions in relation to said lid. This characteristic allows the user to place the foodstuff in the most effective position in relation to the blade support in order to provide the type of cut desired. More precisely, the sleeve has a cylindrical base cooperating with a cylindrical footprint preformed in the lid in order to present these possibilities of orientation.

According to another particularly advantageous characteristic, the said moving blade support comprises at one end a preformed handle in its extension making it easier to move.

According to another characteristic, it is equipped to receive a detachable handle arranged in a plane perpendicular to the cutting plane. Such an arrangement for a handle is particularly suitable for imparting a reciprocating movement in horizontal translation. Moreover, according to another characteristic, the said moving blade support is preformed to receive in a detachable manner one or more interchangeable cutting tools, which offers the user all cutting possibilities. The cutting tool also comprises at least one blade associated with a supporting frame whose cooperation with the moving blade support allows a plurality of cutting thicknesses. According to one characteristic, the cutting tool comprises a blade associated with a supporting frame comprising bearing edges cooperating with notches made in the moving blade support.

The cutting tool may be adapted specifically for the inverted configuration. Indeed, in order to exploit the fact that the blade support performs a back-and-forth translation movement over the foodstuff to be cut, the device of the invention is remarkable in that the cutting tool has a blade with at least two cutting edges arranged symmetrically in relation to each other, the first being active in one direction and the second being active in the other direction of translation of the blade support. This characteristic allows certain types of cutting to be preformed twice as fast.

According to another characteristic, the cutting tool has a cutting edge with a serrated profile that facilitates the cutting of vegetables such as tomatoes and onions.

According to another characteristic, said blade is provided on its lower face with a deflector arranged transversely in relation to the axis of movement of the moving support and formed by a downward projection presenting downward guiding surfaces for the foodstuffs as they are being cut. According to one embodiment, this projection adopts a substantially V-shaped profile. The arms of the V direct the cut portions of foodstuffs downwards and help to detach them.

In order make available near the device various utensils that may be needed, the device comprises an additional container that offers a storage volume for utensils and cooperates with the bottom face of the receptacle so that it fits between the receptacle and the work surface on which the device is standing.

According to a preferred embodiment, the moving support, the lid and the container are made of plastic and the blades of the cutting tool are of stainless steel.

The basic concepts of the invention that have just been described above in their most elementary form and other details and characteristics will emerge more clearly from the following description and accompanying drawings, giving by way of a non-limiting example an embodiment of a device according to the invention.

Description of a Preferred Embodiment

The foodstuff-cutting device shown in the drawings in FIGS. 1 to 4 is indicated by D as a whole. In accordance with an inverted configuration, this device D comprises a blade support 100 which moves in a translational reciprocal movement symbolised by the double arrow F1, in relation to a fixed body. This device D comprises a receptacle 200, here adopting the form of a boat hull.

According to another embodiment, the device D adopts a substantially parallelepiped form having a base and lateral walls that are substantially vertical.

Receptacle 200 comprises in the top part an opening 210 framed by the upper edges 220. These edges 220 are preformed to present sliding and guiding surfaces for the moving blade support 100. To do this, the edges 220 are preformed to adopt an L-shape, the horizontal arm of which serves as a supporting and sliding surface during the translational movement (along the double arrow F1).

At one end of the receptacle, the vertical arm serves as an end stop of said movement while, at the other end, the vertical arm is removed to allow the passage and thus the translational movement of said blade support 100.

The opening 210 receives a lid 300 which, independent of the receptacle 200, closes it by cooperating with said edges 220 and by keeping the said moving blade support 100 in contact with the sliding surfaces.

As shown, the lid 300 is of a size to fit between the vertical arms of the L-shaped profile formed by the edges 220. Moreover, the lid 300 is preformed so as to present longitudinal vertical surfaces to guide the said moving blade support 100 in its movement along the double arrow F1. To do this, the longitudinal edges 130 and 140 of the said moving support 100 are provided with projections cooperating, for the purpose of guiding and holding, with the longitudinal grooves 320 and 330 made in the bottom face of the lid 300.

The portion of the lid 300 covering the edge portion of the receptacle 200 left free to allow the moving blade support to pass, is also open.

Figure 4:
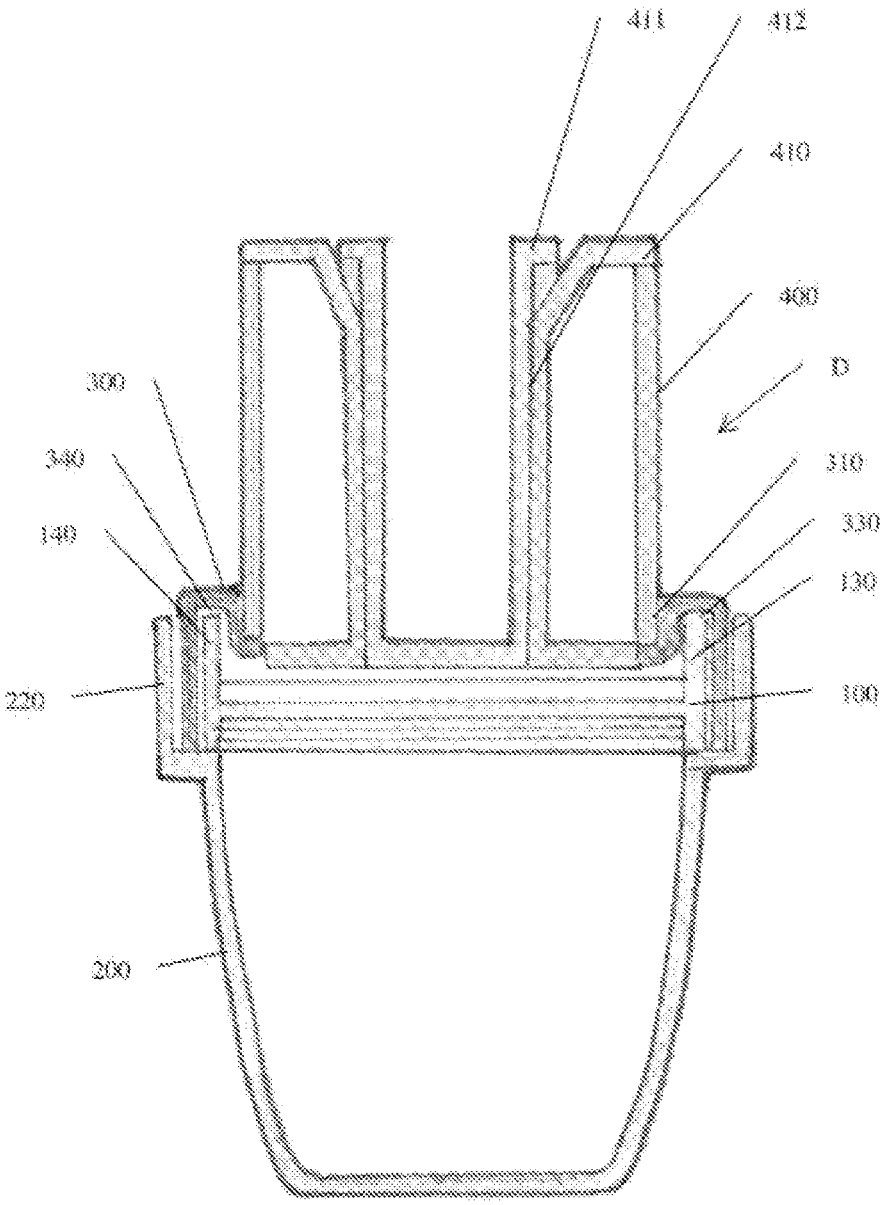
FIG. 4 is a schematic drawing of a sectional view of said device along a cutting plane shown in FIG. 3.

To facilitate handling of the blade, support 100, the latter comprises at one end, as shown in the drawing in FIG. 4, a handle 110 preformed in its extension. According to another embodiment, the blade support is also preformed to receive a detachable handle arranged in a plane perpendicular to the cutting plane.

Said lid 300 is preformed with an opening 310 that, transverse to the travel (double-arrow F1) of the moving support 100, receives a substantially vertical sleeve 400 receiving the foodstuffs to be cut. This sleeve 400 is associated with a plunger 410 that keeps the inserted foodstuffs in the pathway of the moving blade support 100.

The foodstuffs are inserted into the sleeve and pushed down the sleeve 400 by the plunger 410, operated by one hand by the user who, with the other hand, operates the blade support 100 making it follow a translational movement along the double arrow F1 between the receptacle 200 and its lid 300 in order to cut the foodstuff.

As shown, the said food plunger 410 slides in the sleeve 400 and itself receives a smaller plunger 411:

- the first plunger 410 slides being in direct contact with the hollow core of the sleeve 400 and is preformed with a channel 412 to enable smaller foodstuffs to pass through,
- the second 411 slides freely in the channel 412 and allows smaller foodstuffs to be pushed towards the cutting plane.

This sleeve 400 has an oblong profile but is preformed to cooperate with the said lid 300. To achieve this, it has a circular base 420 that cooperates with a round footprint adopted by the opening 310 made in the lid 300. The sleeve 400 and the lid 300 are therefore elements that can be detached from one another, enabling disassembly and adjustment of the position. In fact, this cooperation between a circular base 420 and a circular housing 310 enables the sleeve 400 to adopt several positions in relation to the said lid 300. The sleeve 400 can thus be tilted about its axis to offer several positions and thus several orientations of the foodstuffs in relation to the cutting tools.

As shown, the opening 310 is made in the back part of the lid 300 in order to house the base of the sleeve 400.

Figure 5:
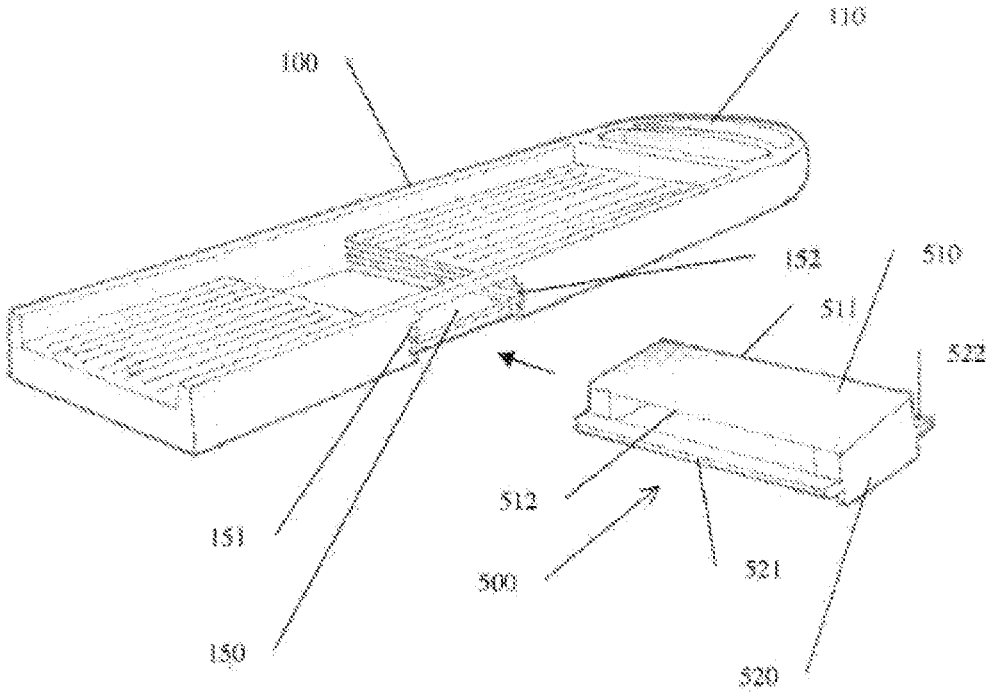
FIG. 5 is a schematic drawing of an exploded perspective view of an embodiment of the blade support, the end of which has been truncated.

As shown in greater detail in the drawing in FIG. 5, the said moving blade support 100 is preformed to house detachably one or more interchangeable cutting tools 500.

According to an embodiment not shown, the back parts of the lid 300 and receptacle 200 are preformed with an opening facilitating the change of tool 500 while the blade support 100 remains engaged in the slide, giving access to the side face of said blade support 100.

It comprises a horizontal frame, one of the lateral edges of which is preformed to constitute the handle 110.

The middle part of the frame is preformed to house the cutting tool 500. The cutting tool 500 comprises a cutting surface 510 associated with a supporting frame 520.

As shown in the drawing in FIG. 5, the cutting surface 510 consists in a blade with two cutting edges 511 and 512 allowing foodstuffs to be cut in both directions of reciprocating translational movement. The supporting frame comprises bearing edges 521 and 522 that cooperate with the pairs of notches 151 and 152 preformed at different heights in the edges of a window 150 made in the thickness of the moving blade support 100. Sliding the bearing edges into one or other of the pairs of notches enables the thickness of cut to be adjusted.

According to another embodiment of the moving blade support, at either side of the cutting tool, two moving plates serve as a foodstuff bearing surface during the translational movement of the blade support. These two plates tilt in relation to a transverse axis, enabling them to adapt the height of their edge by adjusting, for example, the position of said axis.

According to another embodiment, the bearing edges are shims that can be adjusted in thickness in order to contribute to this adjustment.

Figure 6:
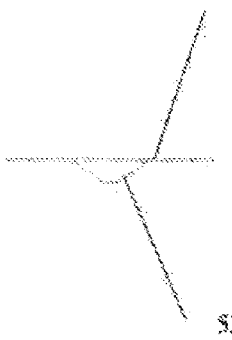
FIG. 6, is a schematic drawings of side, front and top views of an embodiment of a cutting tool
Figure 7:
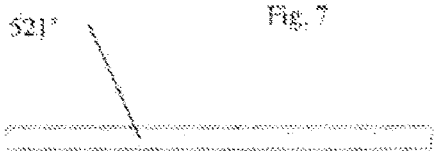
FIG. 7 is another schematic drawings of side, front and top views of an embodiment of a cutting tool
Figure 8:
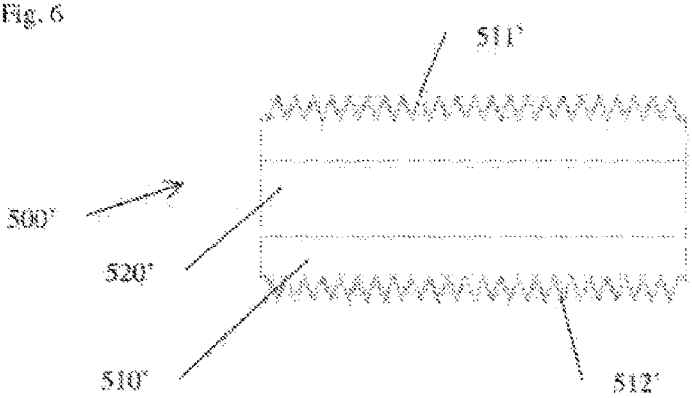
FIG. 8 is yet another schematic drawings of side, front and top views of an embodiment of a cutting tool.

As shown in the drawings in FIGS. 6, 7 and 8, the cutting tool 500' comprises a cutting surface 510' associated with a supporting frame 520'. The cutting surface 510' has two serrated-profile cutting edges. This embodiment is also remarkable in that the supporting frame 520' has in its transverse plane of symmetry in relation to the displacement axis, a downward projection 521' along substantially the entire length of the cutting surface 510', a projection that has a flared V-profile so as to serve as a deflector of the cut foodstuffs. In fact, once the foodstuffs are cut or while they are being cut, the inclined planes defined by the said projection 521' direct them downwards and help to achieve a better cut.

The various utensils, tools and shims can advantageously be stored in an additional container 600 that cooperates with the bottom face of the receptacle 100 so that it fits between the receptacle 200 and the work surface on which the device D is standing.

The receptacle 200 and the container 600 are advantageously provided with non-slip pads on their bottom face.

Note that the above device was described and represented with a view to disclosure rather than as a limitation. Clearly, various arrangements, modifications and improvements can be made to the above example, without departing from the scope of protection of the invention. Thus, for example, an additional container can be associated with the first one.

The foregoing description discloses only exemplary embodiments of the invention. Modifications of the above disclosed apparatus and methods which fall within the scope of the invention will be readily apparent to those of ordinary skill in the art. Accordingly, while the present invention has been disclosed in connection with exemplary embodiments thereof, it should be understood that other embodiments may fall within the spirit and scope of the invention, as defined by the following claims.

What is claimed:

1. A foodstuff-cutting device comprised of: a moving blade support comprised of a cutting tool, and a handle at one end that extends outward from one side of the device along the axis of motion of the blade support such that when the device is in use, said blade support moves in a reciprocating translational movement in relation to the foodstuff as a result of movement of the handle, and thereby the motion of the cutting tool defines a cutting plane, a sleeve associated with a plunger adapted to receive foodstuffs and, when in use, to keep the foodstuffs in the pathway of the moving blade support, a receptacle with an opening having edges presenting sliding surfaces for said moving blade support, a lid which in use closes the receptacle by engaging with said edges and by keeping said moving blade support in contact with the sliding surfaces, said lid being comprised of a passageway which is arranged transversely in relation to the travel of the moving blade support and receives the sleeve associated with the plunger allowing food stuffs to be inserted and kept in the cutting plane of the pathway of the moving blade support, wherein said edges and lid are formed so that the said lid fits into the edges and presents at least one longitudinal vertical sliding surfaces to said moving blade support.

2. The device according to claim 1 where said plunger slides in the sleeve and is further comprised of a first subcomponent that slide which being in direct contact with the sleeve, and is formed with a channel for smaller foodstuffs to pass through, and a second subcomponent that slides in the said channel for smaller foodstuffs.

3. The device according to claim 1 where said passageway has an oblong profile and is formed to cooperate with the said lid in order to allow the sleeve to adopt various positions in relation to said lid.

4. The device according to claim 1 further comprising a storage container comprised of a storage volume in the storage container's interior space for utensils that cooperates with a bottom face of the receptacle so that the storage volume fits between the receptacle and a work surface on which the device is standing.

5. The device according to claim 1 where said moving blade support comprises at one end a preformed handle in its extension.

6. The device according to claim 1 where said moving blade support is adapted to receive in a detachable manner one or more interchangeable cutting tools.

7. The device according to claim 1 where the cutting tool comprises a blade associated with a supporting frame, said frame comprise of bearing edges cooperating with notches in the moving blade.

8. The device according to claim 1 where the longitudinal edges of said moving support are comprised of one or more projections corresponding to one or more longitudinal grooves comprising a bottom face of the lid.

9. The device according to claim 1 where the cutting tool is further comprised of at least a first and second cutting edges arranged symmetrically in relation to each other, the first cutting edge being active when moved in a first direction of translation of the blade support and the second cutting edge being active when moved in a second direction that is opposite to the first direction.

10. The device according to claim 1 where the cutting tool is further comprised of:

a blade provided on its lower face, a downward projection forming an inclined plane arranged transversely in relation to the axis of movement of the moving blade support and presenting downward guiding surfaces for the foodstuffs as they are being cut when in use.

11. The device according to claim 1 where the cutting tool has a cutting edge and a serrated profile.

12. The device according to claim 6 where the cutting tool is comprised of: a blade with at least a first and second cutting edges arranged symmetrically in relation to each other, the first cutting edge being active when in use and moved in a first direction of translation of the blade support and the second cutting edge being active when in use and moved in a second direction that is opposite to the first direction.

13. The device according to claim 6, where the cutting tool is further comprised of:

a blade provided on its lower face, a downward projection forming an inclined plane arranged transversely in relation to the axis of movement of the moving blade support and presenting downward guiding surfaces for the foodstuffs as they are being cut in use.

14. The device according to claim 9 where the cutting tool is further comprised of:

a blade provided on its lower face, a downward projection forming an inclined plane arranged transversely in relation to the axis of movement of the moving blade support and presenting downward guiding surfaces for the foodstuffs as they are being cut in use.

15. The device according to claim 6 where the cutting tool is comprised of a cutting edge with a serrated profile.

16. The device according to claim 9, where the cutting tool is comprised of a cutting edge with a serrated profile.

* * * * *